US007351269B2

(12) United States Patent
Yau

(10) Patent No.: US 7,351,269 B2
(45) Date of Patent: Apr. 1, 2008

(54) SELF CLEANING FILTER AND VACUUM INCORPORATING SAME

(76) Inventor: Lau Kwok Yau, Unit 1, 6/F, 9 Hung To Road, Kwun Tong, Kowloon (HK)

( * ) Notice: Subject to any disclaimer, the term of this patent is extended or adjusted under 35 U.S.C. 154(b) by 469 days.

(21) Appl. No.: 10/744,190

(22) Filed: Dec. 22, 2003

(65) Prior Publication Data

US 2005/0132528 A1 Jun. 23, 2005

(51) Int. Cl.
*B01D 46/04* (2006.01)

(52) U.S. Cl. ..... 55/297; 55/296; 55/298; 55/DIG. 3; 95/282; 15/352

(58) Field of Classification Search ..... 55/283, 55/284, 289, 290, 295, 296, 297, 298, 304, 55/DIG. 3; 15/347, 349, 352; 210/767, 210/791, 796; 96/425, 278, 282
See application file for complete search history.

(56) References Cited

U.S. PATENT DOCUMENTS 1,038,167 A 9/1912 Maitland
3,643,278 A * 2/1972 Harris et al. ..... 15/77
3,959,140 A * 5/1976 Legras ..... 210/107
3,979,194 A * 9/1976 Wiser ..... 55/296
4,027,349 A * 6/1977 Clavin ..... 15/104.12
4,246,011 A * 1/1981 Oberdorfer ..... 96/421
6,625,845 B2 * 9/2003 Matsumoto et al. ..... 15/353
6,758,874 B1 * 7/2004 Hunter, Jr. ..... 55/337
6,928,692 B2 * 8/2005 Oh et al. ..... 15/352
7,070,636 B2 * 7/2006 McCormick et al. ..... 55/299
2002/0088208 A1 * 7/2002 Lukac et al. ..... 55/289

* cited by examiner

*Primary Examiner*—Duane Smith
*Assistant Examiner*—Robert A Clemente
(74) *Attorney, Agent, or Firm*—Roy, Kiesel, Keegan & DeNicola

(57) ABSTRACT

A brush configured to move repeatedly over a vacuum filter. The brush will remove dust particles to prevent them from clogging the filter. In the preferred embodiment, the brush is mounted on a revolving shaft. As the shaft turns it moves the bristles of the brush over the surface of the filter, whereby dust particles may be dislodged. In one embodiment, the shaft is attached to the vacuum motor and is turned directly by the motor. In this embodiment a speed reducer may be employed to slow the rate of rotation of the brush. In another embodiment, a turbine is attached to the shaft. The turbine is placed in the path of the air stream moving through the vacuum. The air passing through the turbine cause it and the shaft to rotate, thereby reducing the load on the motor.

11 Claims, 7 Drawing Sheets

SELF CLEANING FILTER AND VACUUM INCORPORATING SAME

BACKGROUND OF THE INVENTION

1. Field of the Invention

The invention relates to vacuums in general and vacuums containing filters in particular.

2. Prior Art

Vacuum filters screen the flow of air through the vacuum. Dirty dust laden air is kept on one side of the filter, while clean air passes through to the fan and is discharged from the vacuum. With use, dust from the air stream passing through the vacuum tends to build up in the prior art filters. As the filters become more clogged, less and less air can be pulled through the filter. This diminishes the amount of air being drawn into the vacuum which in turn diminishes the strength of the vacuum. Thus, prior art vacuums steadily lose strength over the life of their filters. Eventually, the filters become so clogged that they must be removed and either replaced or cleaned. Accordingly, a vacuum meeting the following objectives is desired.

OBJECTS OF THE INVENTION

It is an object of the invention to provide a vacuum filter that will not become clogged with use.

It is another object of the invention to extend the useful lives of vacuum filters.

It is still another object of the invention to provide a vacuum that does not lose power with time.

It is yet another object of the invention to provide a self cleaning filter for use in vacuums and other similar devices.

It is still another object of the invention to clean the filter of a vacuum without substantially taxing the motor of the vacuum.

It is yet another object of the invention to clean the filter of a vacuum without substantially taxing the power source of the vacuum.

SUMMARY OF THE INVENTION

The invention comprises a brush configured to move repeatedly over the filter of a vacuum or other filtration device. The brush will remove dust particles to prevent them from clogging the filter. In the preferred embodiment, the brush is mounted on a revolving shaft. As the shaft turns it moves the bristles of the brush over the surface of the filter, whereby dust particles may be dislodged. In one embodiment, the shaft is attached to the vacuum motor and is turned directly by the motor. In this embodiment a speed reducer may be employed to slow the rate of rotation of the brush. In another embodiment, a turbine is attached to the shaft. The turbine is placed in the path of the air stream moving through the vacuum. The air passing through the turbine causes it and the shaft to rotate, thereby reducing the load on the motor.

DETAILED DESCRIPTION OF THE PREFERRED EMBODIMENT OF THE INVENTION

Figure 1:
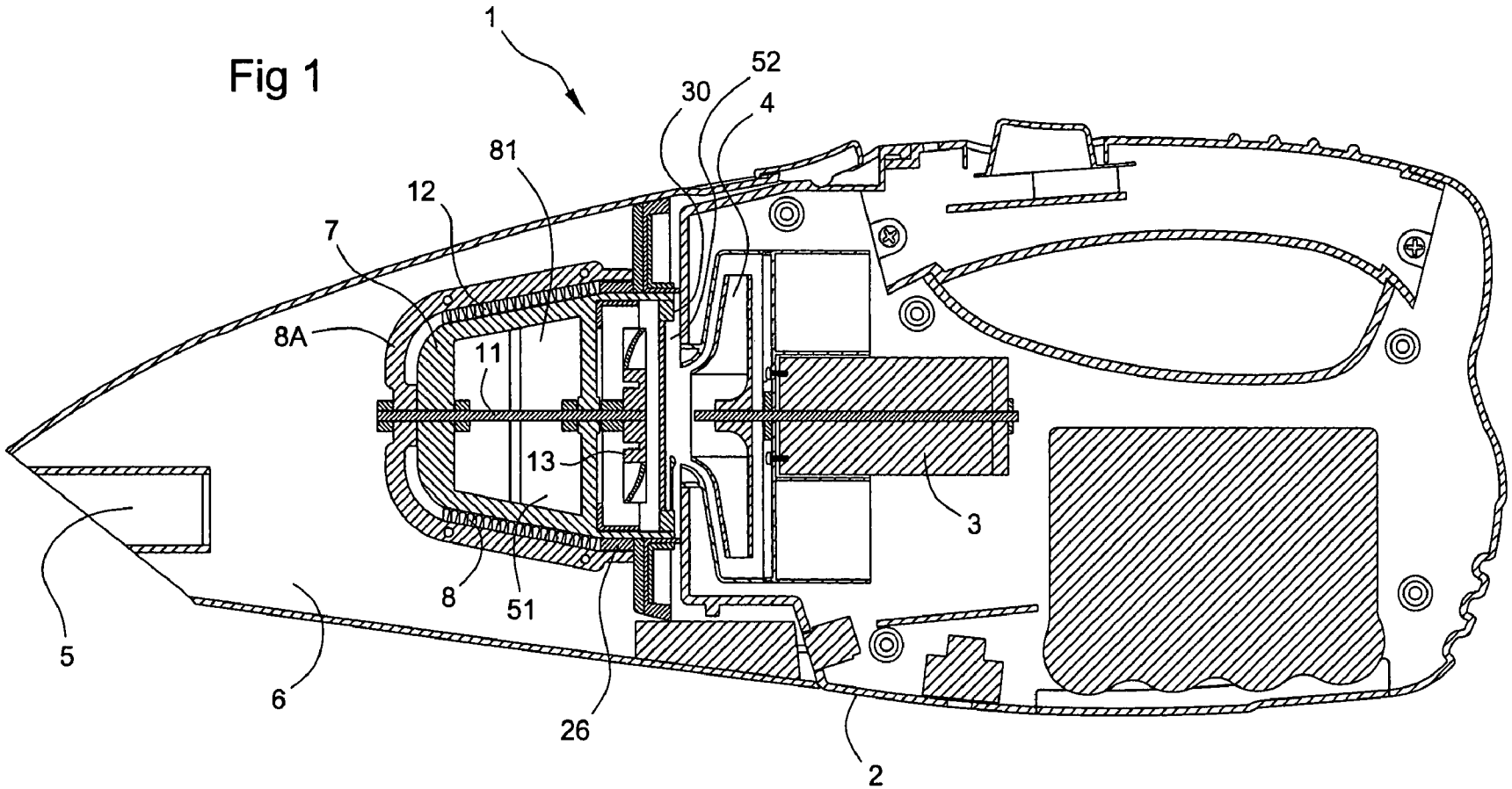
FIG. 1 is cut-away side view of a preferred embodiment of an assembled vacuum employing a preferred embodiment of the invention having a turbine driven brush.
Figure 2:
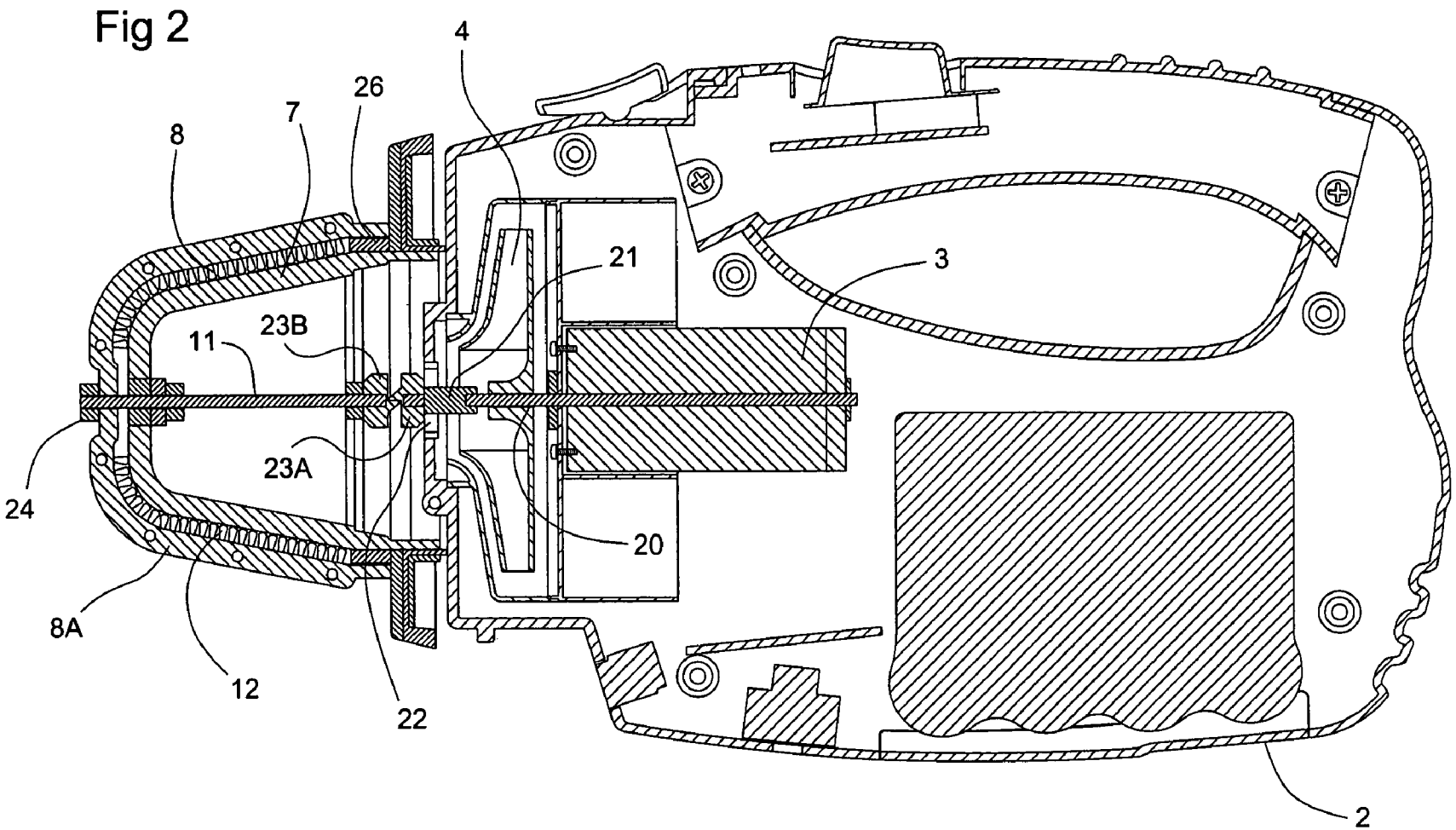
FIG. 2 is a cut-away side view of one preferred embodiment of the invention illustrating a brush in communication with a filter with the brush being driven directly by a vacuum motor.
Figure 3:
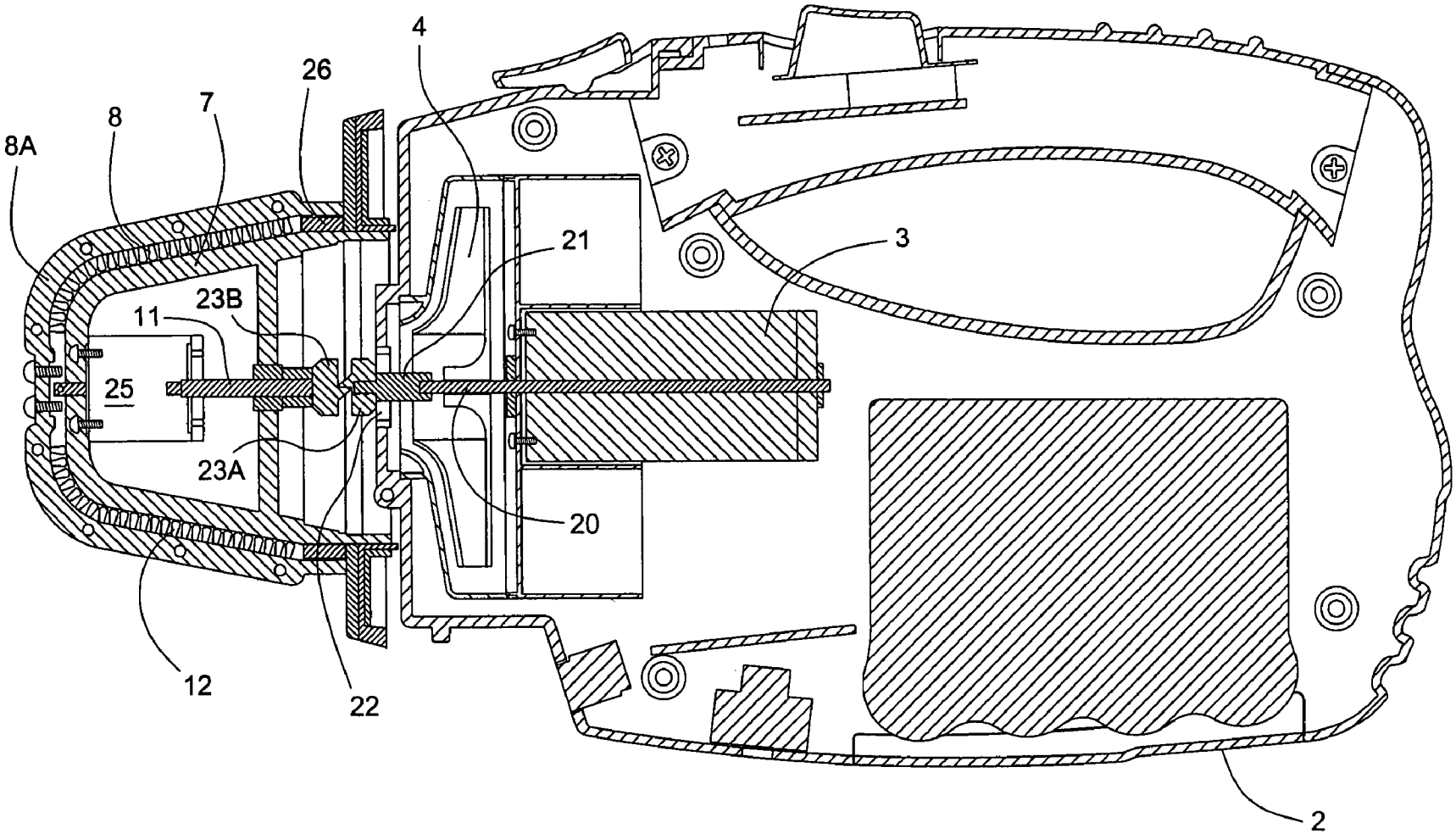
FIG. 3 is a cut-away side view of another preferred embodiment of the invention illustrating a brush in communication with a filter with the brush being driven by a vacuum motor and employing a speed reducer.
Figure 4:
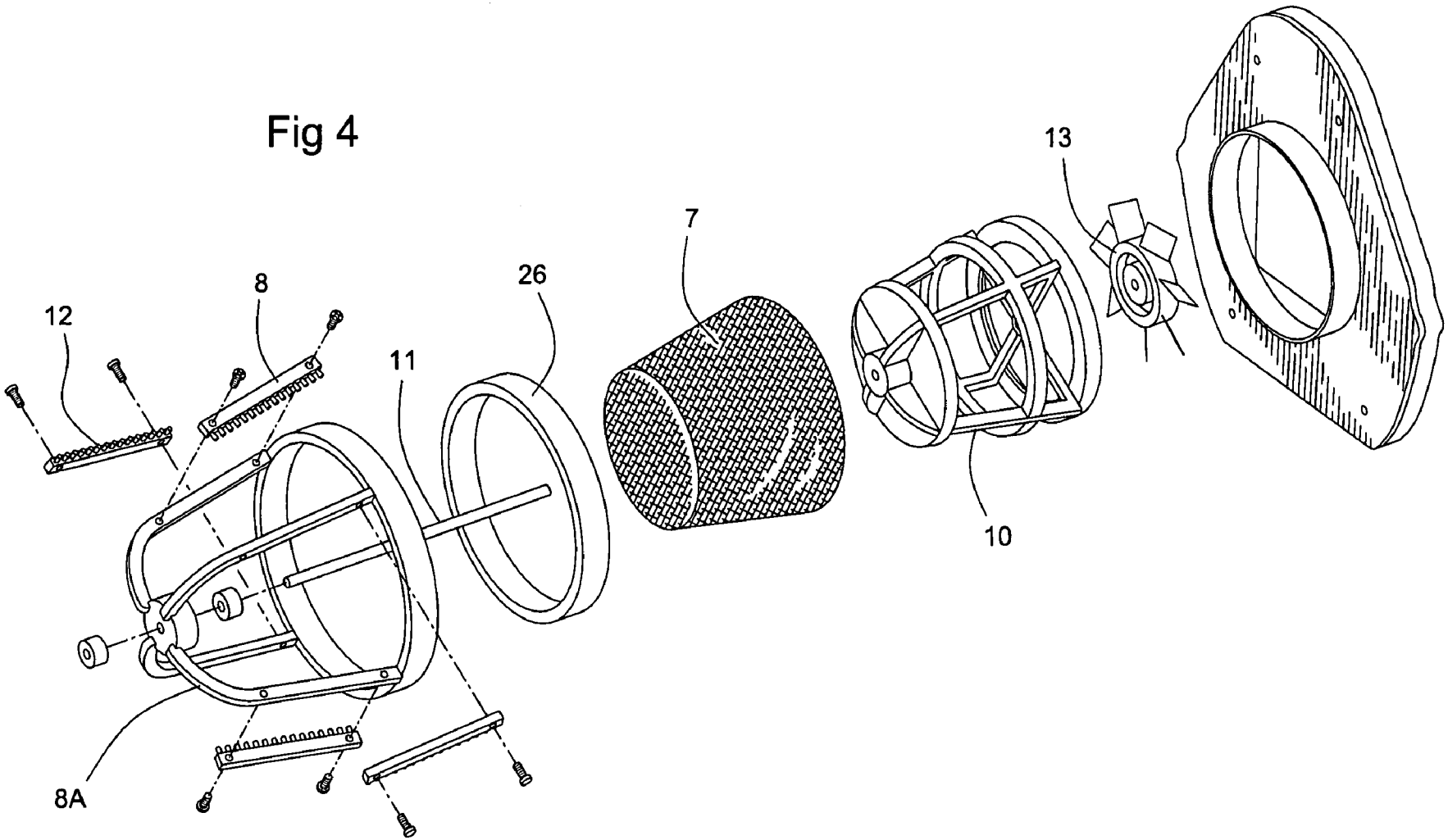
FIG. 4 is an exploded view of a preferred embodiment of a brush, filter and turbine.
Figure 5:
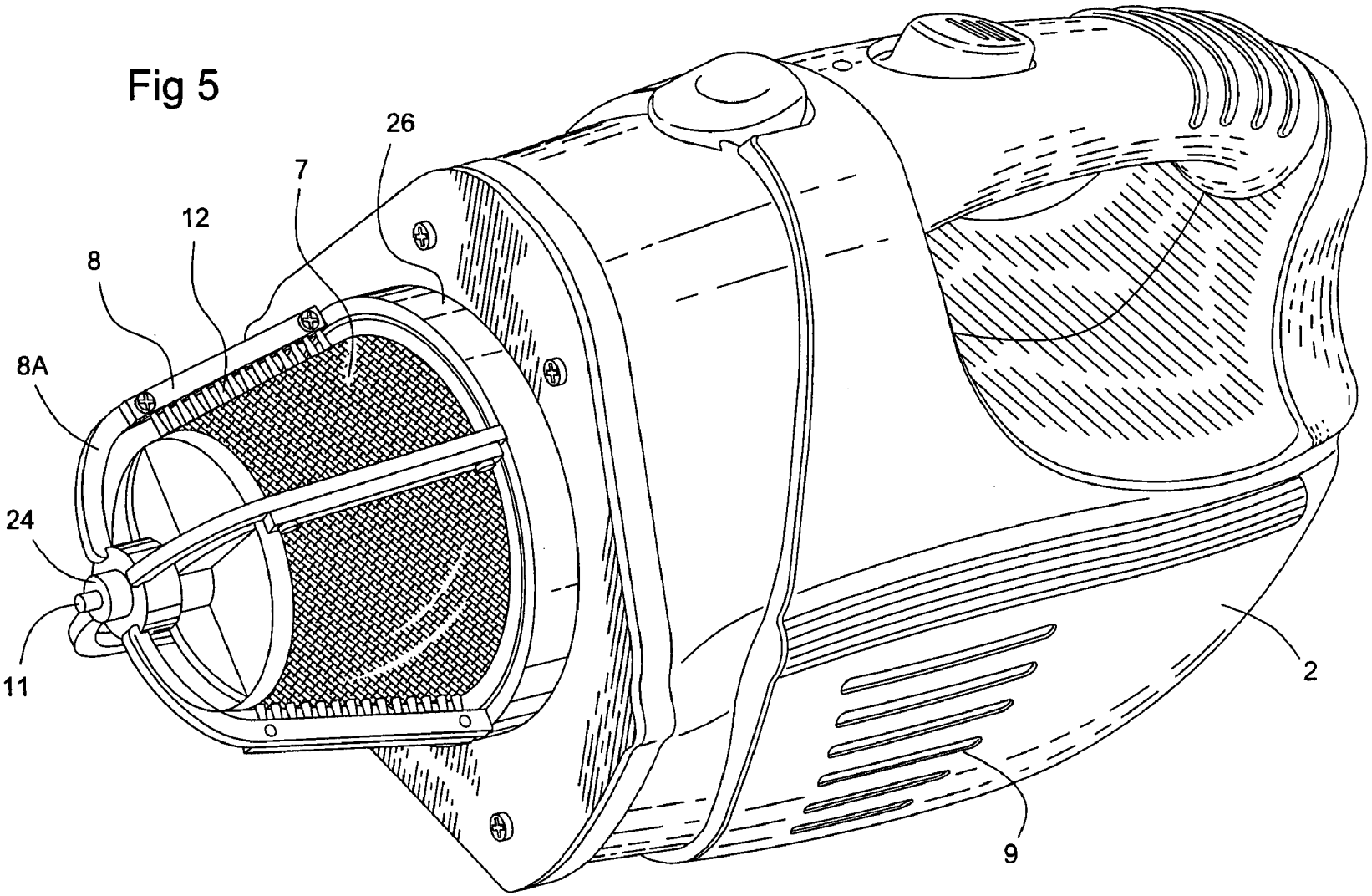
FIG. 5 is a perspective view of a preferred embodiment of a filter with a rotating brush in place.
Figure 6:
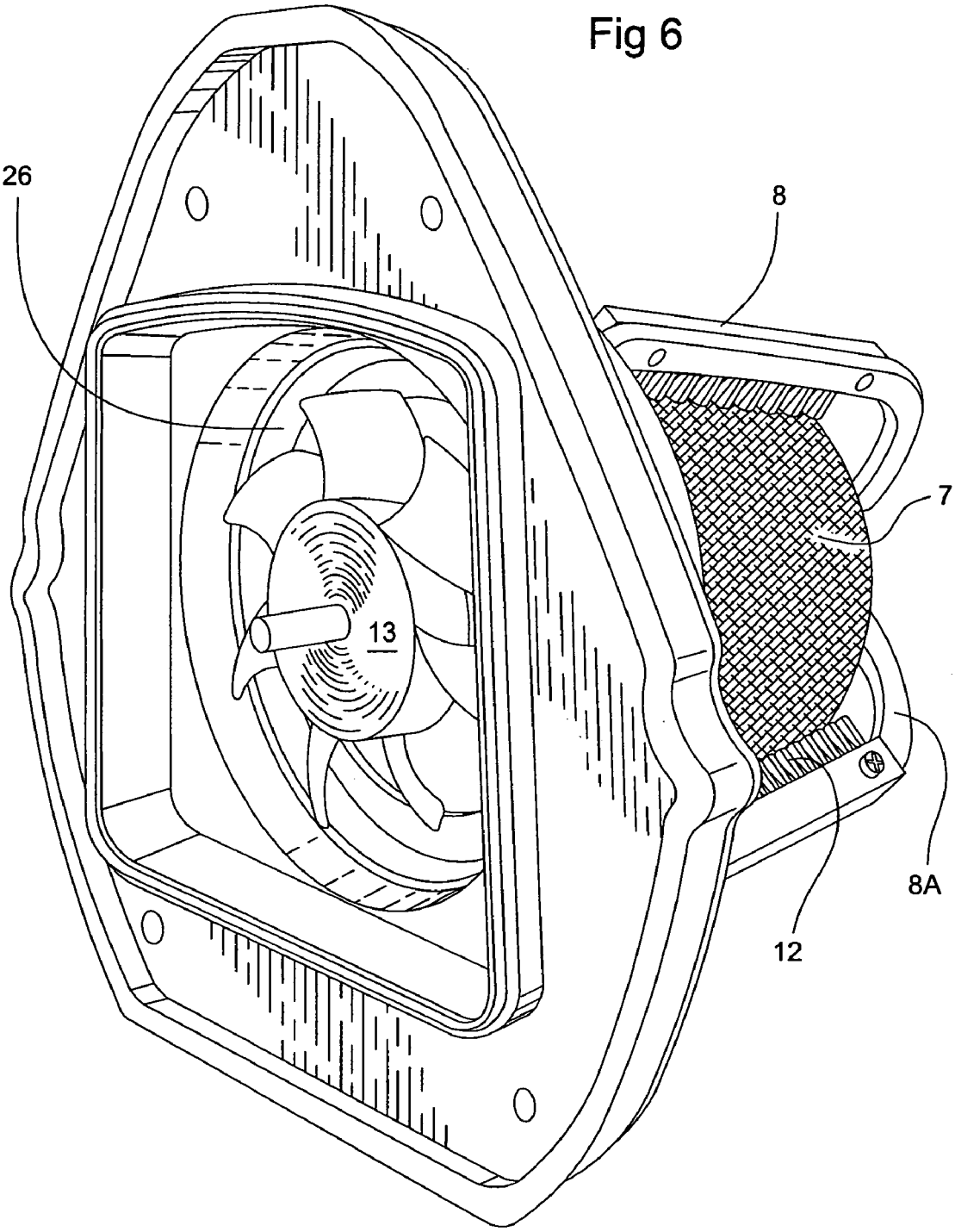
FIG. 6 is a rear perspective view of a preferred embodiment of a turbine driven brush and filter assembly.
Figure 7:
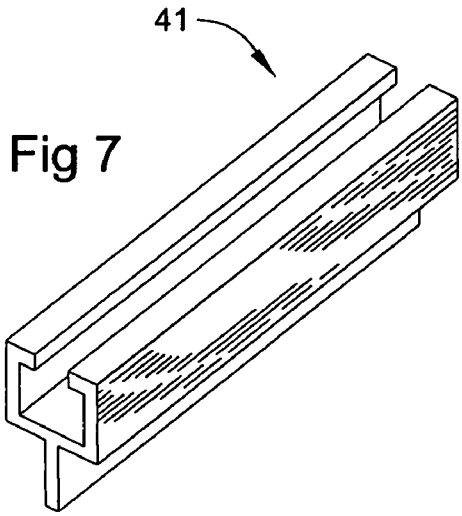
FIG. 7 is a perspective view of a preferred embodiment of a brush frame channel.
Figure 8:
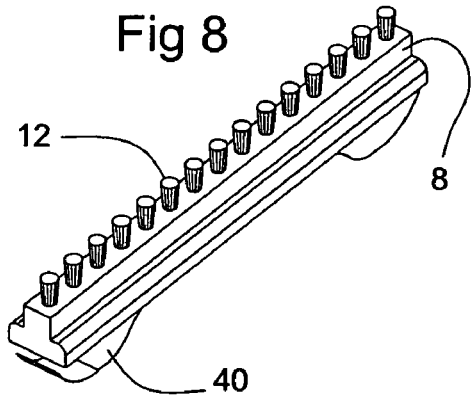
FIG. 8 is a perspective view of a preferred embodiment of a brush having a spring.
Figure 9:
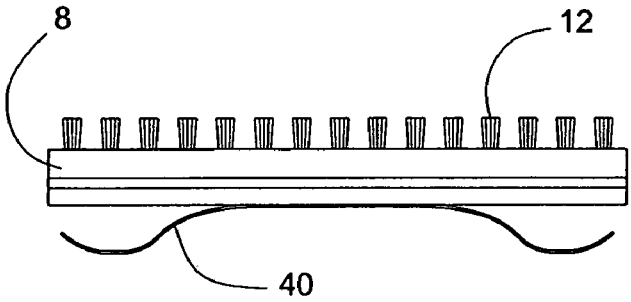
FIG. 9 is a side view of a preferred embodiment of a brush having a spring.
Figure 10:
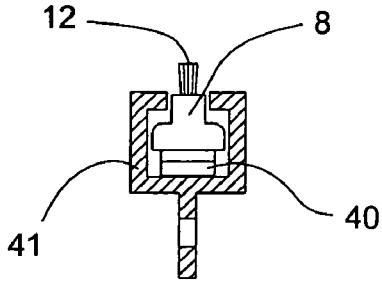
FIG. 10 is a cut away end view of a preferred embodiment of a brush positioned within a brush frame channel.
Figure 11:
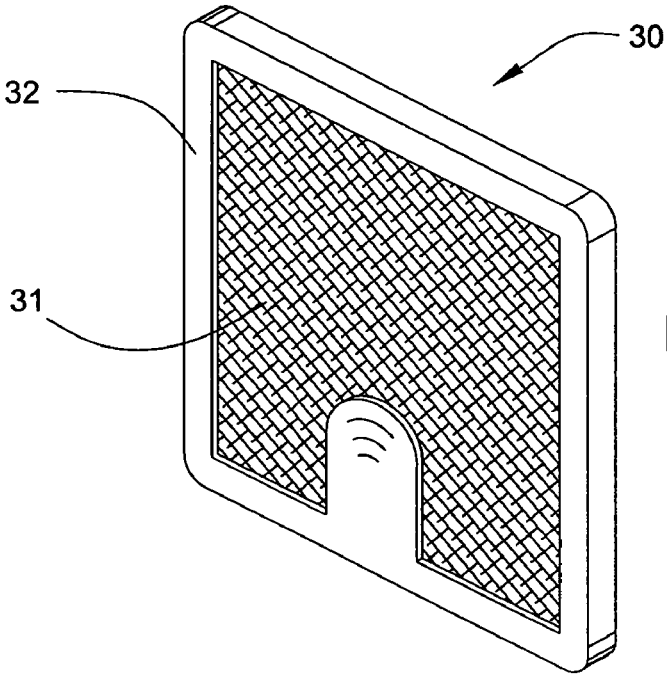
FIG. 11 is a perspective view of a preferred embodiment of a second filter.

One embodiment of the invention comprises an improvement to a vacuum 1. Most vacuums 1 comprise a housing 2 containing a motor 3, typically electric, which drives a fan 4. Fan 4 pulls air through an inlet 5 or other orifice and into a dust collection chamber 6. Dust collection chamber 6 may be integral with housing 2 or it may be in a separate structure. In the preferred embodiment, dust collection chamber 6 is a rigid container, but it may also be a pliable container, as in the case of disposable vacuum bags, or any other conventional vacuum dust collector.

As air is drawn into inlet 5 and dust collection chamber 6 from outside vacuum 1, it picks up dust and other refuse and brings them into vacuum 1. The air exits dust collection chamber 6 through an outlet 51. Outlet 51 should communicate with an intake aperture 52 leading to fan 4. Intake aperture 52 may be in housing 2 and it may be the same aperture as outlet 51. The important thing is that outlet 51 and fan 4 be in fluid communication.

A filter 7 is provided to separate dust collection chamber 6 from the intake area 81 leading to fan 4. This is both to ensure that dust and other refuse remain in dust collection chamber 6 so that they may be discarded and to ensure that the dust does not enter motor 3 or fan 4, where it can cause damage. Air drawn through fan 4 must, of course, be ejected, typically through vents 9. Without filter 7, dust would be ejected with the air, largely defeating the purpose of vacuum 1.

As dust laden air continues to pass through filter 7, dust particles will collect on filter 7. This will reduce the permeability of filter 7. As the permeability of filter 7 decreases, the amount of air able to pass though filter 7 will decrease as well, resulting in a lower overall strength of vacuum 1. Over time, filter 7 will become more and more clogged until it must eventually be removed and cleaned or replaced.

The present invention provides for continuous cleaning of filter 7. In the preferred embodiment, a rotating brush 8 is provided. Brush 8 is configured to continuously sweep over the surface of filter 7 to prevent dust particles from adhering to filter 7. Dislodged dust particles will be retained in dust collection chamber 6 from which they may eventually be discarded. This will prevent filter 7 from clogging and reducing vacuum strength. It will also eliminate the need to replace or clean filter 7 or at least reduce the frequency with which such cleanings or replacements are required.

In the preferred embodiment, filter 7 has the shape of a modified cone that has been flatted at the top. A small frame 10 provides rigidity to filter 7, although filter 7 certainly may be designed to be self-supporting. Brush 8 is mounted on a shaft 11 running through the center of filter 7. In the preferred embodiment, brush 8 is mounted on a brush frame 8A to which shaft 11 is connected. In the preferred embodiment, brush frame 8A will rest on bushing 26 as it rotates about filter 7. As brush frame 8A and brush 8 rotate, bristles 12 of brush 8 contact the surface of filter 7, dislodging dust deposited there.

In the preferred embodiment, brush 8 contains a spring 40 positioned at the base of brush 8. In this embodiment, brush 8 will be mounted within a channel 41 in frame 8A. As bristles 12 wear down, spring 40 will cause brush 8 to extend further from channel 41. This will keep bristles 12 in contact with the surface of filter 7 as bristles 12 wear.

It will be appreciated by those skilled in the field that the orientation and shape of filter 7 is immaterial to the operation of brush 8. If the orientation or shape of filter 7 is changed, the orientation and shape of brush 8 and/or brush frame 8A may be changed as well to allow brush 8 to contact filter 7. Similarly, the motion path of brush 8 may be changed as desired to contact the embodiment of filter 7 in use.

In the preferred embodiment, rotation of brush 8 is effected by rotating shaft 11. Rotation of shaft 11 may be accomplished in one of several ways. Shaft 11 may be connected directly or indirectly to motor 3, such that the rotation of motor 3 will result in the rotation of shaft 11. This will add to the load on motor 3. When vacuum 1 is a "plug-in" model with a continuous source of current from a wall or other outlet, the additional load will usually not pose a substantial problem. However, where vacuum 1 is battery operated, the additional load on motor 3 will result in the battery being drained more quickly, in which case the additional load posed by brush 8 will be a more significant problem.

One way of addressing the potential extra load on motor 3 from brush 8 would be to selectively operate brush 8, limiting the times when brush 8 ran to when it was needed. The connection between brush 8 and motor 3 may be mechanically completed and interrupted by operation of a solenoid or other electrically controlled connector. A switch may be provided that would allow a user to cause the connector to engage and thereby activate the self cleaning feature provided by brush 8 as needed. Alternatively, a timer could be provided which would cause the connector to engage and disengage periodically. Still another option would be to provide a sensor capable of detecting a drop in the flow rate of air through vacuum 1, perhaps by sensing the rpm's of motor 3. If the flow rate dropped below a preset rate, the sensor could cause the connector to engage and activate the self cleaning function.

An alternative way of inducing rotation of shaft 11 and brush 8 is to provide shaft 11 with a turbine 13. Turbine 13 should be positioned in the air path leading to fan 4 such that air entering fan 4 must pass through turbine 13. Air passing through turbine 13 will cause turbine 13 to rotate, thus causing shaft 11, brush frame 8A, and brush 8 to rotate. Unlike a direct connection between shaft 11 and motor 3, turbine 3 will not significantly increase the load on motor 3, thereby conserving battery life when vacuum 1 is battery powered. This embodiment can also be useful in other applications of the invention outside of the vacuum field, particularly where a power source for brush 8 is not readily available.

In one preferred embodiment, motor 3 will be provided with a motor shaft 20 which may be used to drive shaft 11. In this embodiment, a coupling pin 21 will engage motor shaft 20. A first bearing 22 will connect coupling pin 21 to a first coupler 23A. First coupler 23A will mate with second coupler 23B such that when first coupler 23A is rotated, second coupler 23B will rotate as well. Second coupler 23B engages shaft 11 at one end. At the opposite end, shaft 11 connects to brush frame 8A. A gasket or stopper 24 is provided to prevent dust from penetrating filter 7 at this connection point. As motor 3 and motor shaft 20 rotate, shaft 11, brush frame 8A and brush 8 will rotate. Brush 8 will contact and clean filter 7 as brush 8 rotates.

When motor 3 is used to turn brush frame 8A and brush 8, it may be desirable to slow the rate of rotation of brush 8. Electric motors used in typical vacuums may drive motor shaft 20 at rates of 23,600 rotations per minute ("rpm's") and higher, and this rate may vary substantially among different types of vacuums. Such high speeds will typically not be needed in brush 8 and could damage brush 8 or filter 7 in some applications. In the preferred embodiment, desired rotational rates for brush 8 will usually be only about 20 rpms, although higher rates may be utilized when needed for a particular application.

To achieve such a reduction, a speed reducer 25 may be used. Speed reducer 25 may employ any number of mechanisms to reduce the rotational speed being transmitted from motor 3 to brush 8. Such common mechanisms include planetary gears, wobble gears, pinion gears, and belts and pulleys. In the preferred embodiment, speed reducer 25 will effect a 1000:1 reduction in the rpms of motor 3 as applied to brush 8. The preferred speed reducer 25 is the model number R-20C1 available from the Sayama Precision Co, Ltd. of 15-1, 2 Chome, Fujimi, Sayama City, Saitama, Japan 350-1393.

In this embodiment, coupling pin 21 will still engage motor shaft 20, first bearing 22 will connect coupling pin 21 to first coupler 23A which will engage second coupler 23B, and second coupler 23B will still engage shaft 11. However, shaft 11 will not engage brush frame 8A directly. Rather, shaft 11 will engage speed reducer 25. Speed reducer 25 will engage brush frame 8A and will cause brush frame 8A to rotate at the desired rate. Although the inventor contemplates slowing brush 8 with respect to motor 3, if an increase in speed were desired, similar but inverted gearing or pulley mechanisms could be utilized as needed.

In the preferred embodiment, filter 7 will be a resilient stiff material such as stainless steel having an opening size of about 200 apertures per square inch; however, plastics and other materials with different opening sizes may be utilized as desired. In order to provide additional protection for motor 3 and fan 4, it may be desirable to include a second filter 30. Second filter 30 will contain a filter media 31 preferably having about 200 apertures per square inch. Filter media 31 will preferably be a fabric such as paper of HEPA quality commonly used in prior art vacuums. It will be appreciated that in an embodiment where second filter 30 is employed, the presence of filter 7 and brush 8 will substantially prolong the useful life of second filter 30.

Second filter 30 should preferably be positioned between filter 7 and fan 4 to catch any particles that pass through filter 7. When second filter 30 is used, filter 7 may be configured to be threaded or to snap on and off or to otherwise be removable in order to provide access to second filter 30 so that second filter 30 may be changed and/or cleaned as necessary.

In the preferred embodiment, second filter 30 is a flat rubber framed panel. Filter media 31 is positioned within rubber frame 32. In embodiments utilizing turbine 13, no passage through second filter 30 will be needed. However, when motor 3 is used to turn brush 8 directly, an aperture for shaft 11 may be provided in second filter 30. Another alternative would be to magnetically couple shaft 11 to motor 3 such that revolution of motor 3 would cause shaft 11 to rotate without shaft 11 having to penetrate second filter 30. Of course, other shapes for second filter 30 and/or intake aperture 52 may be used as desired.

Although the embodiment of vacuum 1 shown in the figures is a hand-held model, the invention is not so limited. Those skilled in the field will appreciate that the present invention may be employed in upright vacuums, full size vacuums, and any other vacuum 1 employing a filter. Moreover, the invention could be employed in other filtration settings not involving a vacuum. The invention could also be used in environments where the fluid being filtered was a gas other than air or even a liquid. Accordingly, a scope of protection consistent with the following claims is desired.

I claim:

1. A vacuum cleaner comprising:

a housing containing a motor configured to drive a fan, said fan positioned to draw air through an air intake aperture and discharge air through a vent;

a dust collection chamber operatively attached to said housing, said dust collection chamber having an inlet and an outlet, said inlet configured to allow air and airborne particles to enter said dust collection chamber, said outlet positioned to fluidly communicate with said air intake aperture for said fan;

a first filter configured to prevent at least some of said airborne particles from reaching said fan;

a movable brush configured to encounter said first filter as said brush moves, whereby at least some of said airborne particles that adhere to said first filter may be dislodged by said brush; and wherein said brush is operatively connected to said motor whereby operation of said motor will cause said brush to move.

2. A vacuum cleaner according to claim 1 wherein said connection between said motor and said brush includes a speed reducer configured to drive said brush at a lower speed than said motor.

3. A vacuum cleaner according to claim 1 further comprising a second filter positioned between said first filter and said fan.

4. A vacuum cleaner according to claim 1 wherein said brush is mounted on a frame.

5. A vacuum cleaner according to claim 4 wherein said frame further comprises a channel.

6. A vacuum cleaner according to claim 5 wherein said brush is positioned within said channel.

7. A vacuum cleaner according to claim 6 wherein said brush further comprises bristles, a base, and a spring extending from said base, whereby expansion of said spring will cause said bristles to extend further from said frame.

8. A self cleaning filter assembly positioned in a fluid line containing a passage, said assembly comprising a filter positioned to require all fluid passing through said passage to pass through said filter, said filter configured to prevent selected particles from passing through said passage;

a moveable brush configured to encounter said filter as said brush moves, whereby at least some of said selected particles that adhere to said filter may be dislodged by said brush;

wherein said brush is mounted on a shaft whereby rotation of said shaft will cause said brush to rotate;

said self cleaning filter assembly further comprising a turbine.

9. A self cleaning filter assembly according to claim 8 wherein said turbine is operatively attached to said shaft, whereby rotation of said turbine will result in rotation of said shaft.

10. A self cleaning filter assembly according to claim 9 wherein said fluid flows through said fluid line.

11. A self cleaning filter assembly according to claim 10 wherein said turbine is positioned in the path of said flowing fluid, whereby said turbine may be driven by said fluid.

* * * * *